US009217439B2

(12) United States Patent
Kabasawa

(10) Patent No.: US 9,217,439 B2
(45) Date of Patent: Dec. 22, 2015

(54) VACUUM PUMP

(75) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 529 days.

(21) Appl. No.: 13/698,008

(22) PCT Filed: May 20, 2011

(86) PCT No.: PCT/JP2011/062147
§ 371 (c)(1),
(2), (4) Date: Nov. 14, 2012

(87) PCT Pub. No.: WO2012/002084
PCT Pub. Date: Jan. 5, 2012

(65) Prior Publication Data

US 2013/0058782 A1 Mar. 7, 2013

(30) Foreign Application Priority Data

Jul. 2, 2010 (JP) ..... 2010-151981

(51) Int. Cl.
*F04D 19/04* (2006.01)
*F04D 29/64* (2006.01)

(52) U.S. Cl.
CPC ..... *F04D 19/042* (2013.01); *F04D 19/044* (2013.01); *F04D 19/046* (2013.01); *F04D 29/644* (2013.01)

(58) Field of Classification Search
CPC ... F04D 19/042; F04D 29/644; F04D 29/642; F04D 29/64
See application file for complete search history.

(56) References Cited

U.S. PATENT DOCUMENTS

| | | | | |
|---|---|---|---|---|
| 7,160,082 | B2 * | 1/2007 | Allen et al. | 415/229 |
| 2003/0086784 | A1 * | 5/2003 | Stuart | 415/90 |
| 2003/0170132 | A1 * | 9/2003 | Englander et al. | 417/423.4 |

FOREIGN PATENT DOCUMENTS

| | | | |
|---|---|---|---|
| CN | 1878962 | A | 12/2006 |
| JP | 3098139 | B2 | 10/2000 |

(Continued)

OTHER PUBLICATIONS

First Office Action dated Oct. 28, 2014 for corresponding Chinese Application No. 201180028975.
Notification of Reasons for Refusal dated Sep. 24, 2014 for corresponding Japanese Application No. 2012-522525.
PCT International Search Report dated Jun. 28, 2011 from corresponding PCT Application No. PCT/JP2011/062147, filed May 20, 2011.

(Continued)

*Primary Examiner* — Edward Look
*Assistant Examiner* — Christopher J Hargitt
(74) *Attorney, Agent, or Firm* — Westman, Champlin & Koehler, P.A.

(57) ABSTRACT

Disclosed is a low-cost composite-type vacuum pump having a strength capable of withstanding high loads and using a cylindrical rotor formed from a fiber-reinforced plastic material. Having a turbo-molecular pump section (14) and a thread groove pump section (15), the composite vacuum pump is formed by press-fitting a joint portion (20*a*) of a rotor (17) of the turbo-molecular pump section (14) into the upper end section of a cylindrical rotor (21) formed from the fiber-reinforced plastic material of the thread groove pump section (15). The joint portion (20*a*) of the rotor (17) is formed on the lower end side of the rotor (17) integrally with said rotor (17) and in the shape of a cylinder with an L shaped cross section, and is provided with: a contact portion (28) having an outer diameter enable press-fitting into the inner peripheral face of the cylindrical rotor (21); and a small-diameter section (29) positioned above said contact portion (28) and, having an outer diameter smaller than the inner diameter of the aforementioned cylindrical rotor (21), capable of being placed inside the cylindrical rotor (21) away from the inner peripheral face of the cylinder rotor (21).

7 Claims, 13 Drawing Sheets

(56) References Cited

FOREIGN PATENT DOCUMENTS

| | | | |
|---|---|---|---|
| JP | 2003506630 | A | 2/2003 |
| JP | 2003172289 | A | 6/2003 |
| JP | 2004278512 | A | 10/2004 |
| JP | 2006291794 | A | 10/2006 |

OTHER PUBLICATIONS

PCT International Written Opinion dated Jun. 28, 2011 from corresponding PCT Application No. PCT/JP2011/062147, filed May 20, 2011.

* cited by examiner

VACUUM PUMP

BACKGROUND OF THE INVENTION

1. Field of the Invention

The present invention relates to a vacuum pump, and more particularly to a vacuum pump that can be used in a pressure range from low vacuum to high vacuum and ultra-high vacuum, in an industrial vacuum system that is used in semiconductor manufacturing, high-energy physics and the like.

2. Description of the Related Art

In the present description an example will be explained of a composite-type vacuum pump that is provided with a turbo-molecular pump section and a thread groove pump section. Conventional composite-type vacuum pumps of this type have a structure wherein a turbo-molecular pump section 104 and a cylindrical thread groove pump section 105 are sequentially disposed inside a chassis 103, having an intake port 101 and a discharge port 102, from the intake port 101 side, as illustrated in the vertical cross-sectional diagram of a composite-type vacuum pump in a conventional embodiment illustrated in FIG. 12. FIG. 13 is an enlarged diagram of section B of FIG. 12.

In FIG. 12, the reference numeral 106 denotes a rotating shaft of a rotor 107 of the cylindrical thread groove pump section 105 and the turbo-molecular pump section 104, and the reference numeral 108 denotes a motor that causes the rotating shaft 106 to rotate.

In this conventional composite-type vacuum pump 100, the rotor 107 of the cylindrical thread groove pump section 105 is made of an aluminum alloy. The highest revolutions that the composite-type vacuum pump can achieve are limited thus by the strength of the rotor 107 at the cylindrical thread groove pump section 105.

Such being the case, a cylindrical rotor 109 that results from shaping, to a cylindrical shape, a fiber-reinforced plastic material (fiber-reinforced plastic, ordinarily referred to as "FRP material"), may be used as the rotor in the thread groove pump section of the composite-type vacuum pump. Structures for increasing the strength of such a cylindrical rotor are also known.

As the fiber-reinforced plastic material there can be used, for instance, aramid fibers, boron fibers, carbon fibers, glass fibers, polyethylene fibers and the like.

A combination of dissimilar types of material is thus used in a case where a cylindrical rotor 109 of a fiber-reinforced plastic material (hereafter, "FRP material") is disposed at the lower end section of the rotor 107 of the turbo-molecular pump section 104 in the composite-type vacuum pump, and hence differences arise in the extent of deformation caused by centrifugal force and by thermal expansion. Therefore, this raised the concern of joint portion loosening, or, contrariwise, the concern of breakage of the cylindrical rotor 109, which is made of an FRP material, on account of a high load acting thereon. In particular, fibers break off at the end face of the cylinder, and hence the strength in the vicinity of the end face is lower than at other portions. This raised the concern of easy breakage of that portion when acted upon by a load.

From the viewpoint of securing concentricity by preventing tilting of the cylindrical rotor 109, and from the viewpoint of weight reduction, the joint portion 110 of the rotor 107 is ordinarily shaped in an L-shaped cross section and comprise a disc-like portion 110*a* and a joining portion 110*b*. Such a structure affords a load-relieving effect through deflection of a lower portion side of the joining portion 110*b*. In an FRP structure, however, there is hardly any deflection in the vicinity of the end face, at which strength is weakest, and hence hardly any load-relieving effect is afforded.

Various conventionally known measures to tackle the above occurrence have been proposed, for instance those disclosed in Japanese Patent No. 3098139 and Japanese Patent Application Publication No. 2004-278512.

In the composite-type vacuum pump of Japanese Patent No. 3098139, specifically, the rotor of the turbo-molecular pump section and the cylindrical rotor of the thread groove pump section are joined to each other by way of a support plate of FRP material in order to mitigate the difference in the extent of deformation caused by centrifugal force and differences in thermal expansion between the turbo-molecular pump section and the thread groove pump section.

In the composite-type vacuum pump disclosed in Japanese Patent Application Publication No. 2004-278512, the winding angle of fibers in the FRP material, as well as shapes and shaping conditions, such as resin content, are so designed as to mitigate the difference in the extent of deformation caused by centrifugal force and differences in thermal expansion between the turbo-molecular pump section and the thread groove pump section.

However, the structure disclosed in Japanese Patent No. 3098139, wherein the rotor of the turbo-molecular pump section and the cylindrical rotor of the thread groove pump section were joined to each other by way of a support plate of an FRP material, was problematic on account of the increased number of parts and greater assembly man-hours that such a structure involved. Moreover, assembly was difficult to achieve with good precision, and the clearance with respect to a fixed section had to be made wider than in a conventional instance, in order to prevent contact with the fixed section. This entailed lower evacuation performance, which was likewise problematic.

In the structure disclosed in Japanese Patent Application Publication No. 2004-278512, i.e. a structure wherein the winding angle of fibers of an FRP material, and shaping shapes and conditions, such as resin content, were variously designed, the shape of the FRP material was a complex one, which was problematic in terms of poorer productivity and higher costs that this entailed.

SUMMARY OF THE INVENTION

Therefore, it is an object of the present invention to solve the technical problem to be solved and that arises herein, namely the need for providing a composite-type vacuum pump that uses a cylindrical rotor obtained through shaping of a fiber-reinforced plastic material, such that the composite-type vacuum pump is strong enough to withstand high loads and is amenable to reduction in cost.

The present invention is proposed in order to achieve the above goal. The invention set forth in a first aspect provides a vacuum pump that has a cylindrical rotor that constitutes at least a thread groove pump section or a Goethe pump section, etc., and a second rotor that connects the cylindrical rotor and a rotating shaft to each other, the vacuum pump being configured by joining a part of a side surface of the cylindrical rotor to a joint portion that is provided at an annular-brim portion formed in the second rotor, wherein an upper end face of the cylindrical rotor protrudes above a contact portion between the cylindrical rotor and the second rotor.

The invention set forth in a second aspect provides a vacuum pump that has a cylindrical rotor that constitutes at least a thread groove pump section or a Goethe pump section, etc., and a second rotor that connects the cylindrical rotor and a rotating shaft to each other, the vacuum pump being configured by joining a part of a side surface of the cylindrical rotor to a joint portion that is provided at an annular-brim portion formed in the second rotor, wherein the joint portion is formed in an L-shape that protrudes below the annular-brim portion, and an upper end face of the cylindrical rotor is escaped below the annular-brim portion.

The invention set forth in a third aspect provides a vacuum pump that has a cylindrical rotor that constitutes at least a thread groove pump section or a Goethe pump section etc., and a second rotor that connects the cylindrical rotor and a rotating shaft to each other, the vacuum pump being configured by joining a part of a side surface of the cylindrical rotor to a joint portion that is provided at an annular-brim portion formed in the second rotor, wherein the joint portion is formed in an L-shape that protrudes above the annular-brim portion, and an upper end face of the cylindrical rotor is disposed above the annular-brim portion.

The invention set forth in a fourth aspect provides a vacuum pump that has a cylindrical rotor that constitutes at least a thread groove pump section or a Goethe pump section, etc., and a second rotor that connects the cylindrical rotor and a rotating shaft to each other, the vacuum pump being configured y joining a part of a side surface of the cylindrical rotor to a joint portion that is provided at an annular-brim portion formed in the second rotor, wherein the joint portion is formed in an L-shape that protrudes below the annular-brim portion, a small-diameter section is provided at an upper portion of the joint portion, a contact portion between the cylindrical rotor and the second rotor is escaped below the annular-brim portion, and an upper end face of the cylindrical rotor protrudes above the contact portion.

The invention set forth in a fifth aspect provides the vacuum pump set forth in the first aspect or the fourth aspect, wherein the length of a protruding portion of the cylindrical rotor is twice or more a thickness of the cylindrical rotor.

The invention set forth in a sixth aspect provides the vacuum pump set forth in the first, second, third, fourth or fifth aspect, wherein the second rotor constitutes a pump mechanism by at least a turbo-molecular pump section or a vortex pump section. etc.

In the invention set forth in the first aspect, an upper end face of the cylindrical rotor protrudes above a contact portion of the cylindrical rotor and the second rotor; as a result, it becomes possible to prevent a high load from acting on the upper end face of a cylinder that has a lower material strength than other portions.

In the invention set forth in the second aspect, a joint portion is formed to an L-shape that protrudes below an annular-brim portion, and an upper end face of a cylindrical rotor is escaped below the annular-brim portion. Loads can be eased thereby through deflection of the protruding section of the joint portion. As a result, it becomes possible to prevent a high load from acting on the upper end face of a cylinder that has a lower material strength than other portions.

In the invention set forth in the third aspect, a joint portion is formed to an L-shape that protrudes below an annular-brim portion, and an upper end face of a cylindrical rotor is escaped below the annular-brim portion. Loads can be eased thereby through deflection of the protruding section of the joint portion. As a result, it becomes possible to prevent a high load from acting on the upper end face of a cylinder that has a lower material strength than other portions.

In the invention set forth in the fourth aspect, a joint portion is formed to an L-shape that protrudes below an annular-brim portion, a small-diameter section is provided at an upper portion of the joint portion, and a contact portion of a cylindrical rotor and a second rotor is escaped under the annular-brim portion. Loads can be eased thereby through deflection of the protruding section of the joint portion. Also, the upper end face of the cylindrical rotor protrudes above the contact portion. As a result, it becomes possible to prevent a high load from acting on the upper end face of a cylinder that has a lower material strength than other portions.

In the invention set forth in the fifth aspect, the length of a protruding portion of a cylindrical rotor is set to be twice or more the thickness of the cylindrical rotor. As a result, it becomes possible to sufficiently prevent a high load from acting on the upper end face of a cylinder that has a lower material strength than other portions.

In the invention set forth in the sixth aspect, a second rotor constitutes a pump mechanism such as a turbo-molecular pump section or a vortex pump section. As a result, a vacuum pump can be provided that can operate over a wide pressure range.

DESCRIPTION OF THE PREFERRED EMBODIMENTS

In the present invention, the goal of providing a composite-type vacuum pump that uses a cylindrical rotor obtained through shaping of a fiber-reinforced plastic material, such that the composite-type vacuum pump is strong enough to withstand high loads, and is amenable to reduction in cost, was attained by providing a vacuum pump that comprises a cylindrical rotor that has at least a thread groove pump section or a Goethe pump section, and a rotor that has a turbo-molecular pump section or a vortex pump section or the like, the vacuum pump being configured through joining of part of a side surface of the cylindrical rotor to a joint portion that is provided at an annular-brim portion formed in the rotor, wherein the joint portion is formed, integrally with the annular-brim portion, to an L-shape.

Embodiments

Figure 1:
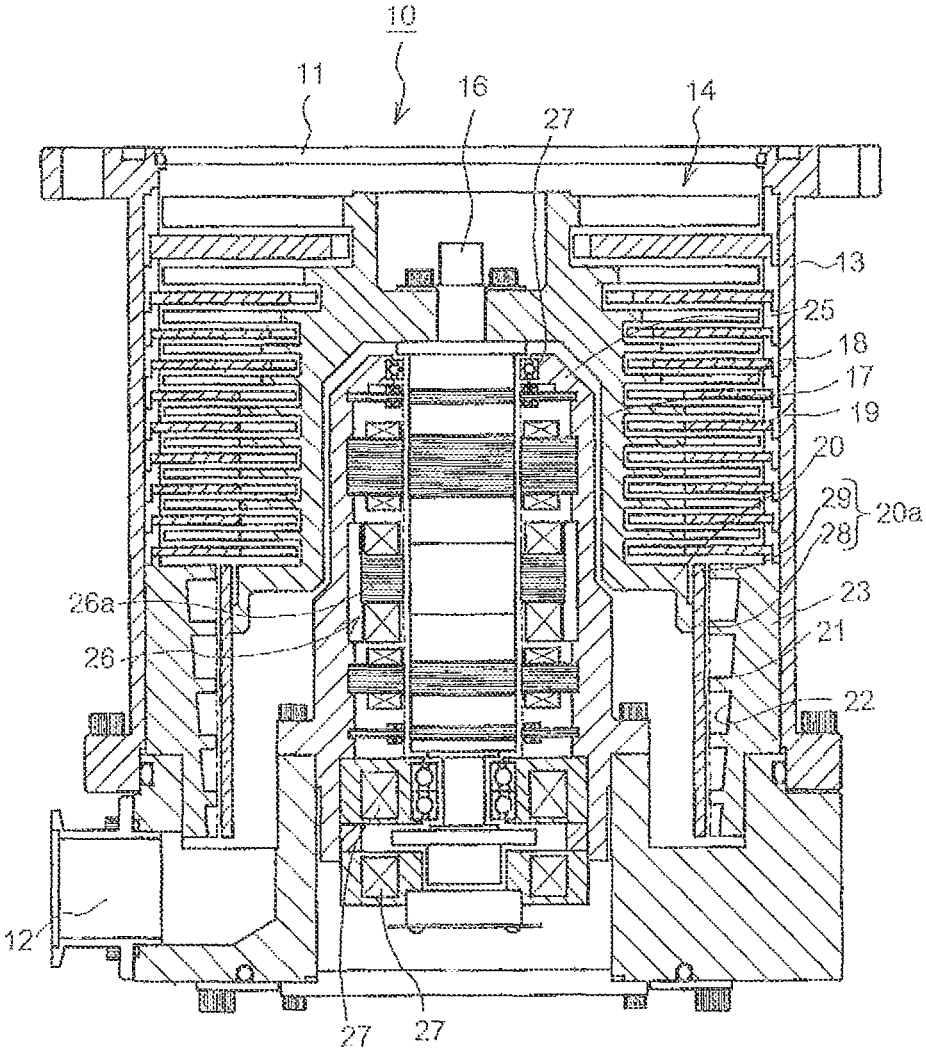
FIG. 1 is a vertical cross-sectional diagram of a composite-type vacuum pump illustrated as an embodiment of the present invention.
Figure 2:
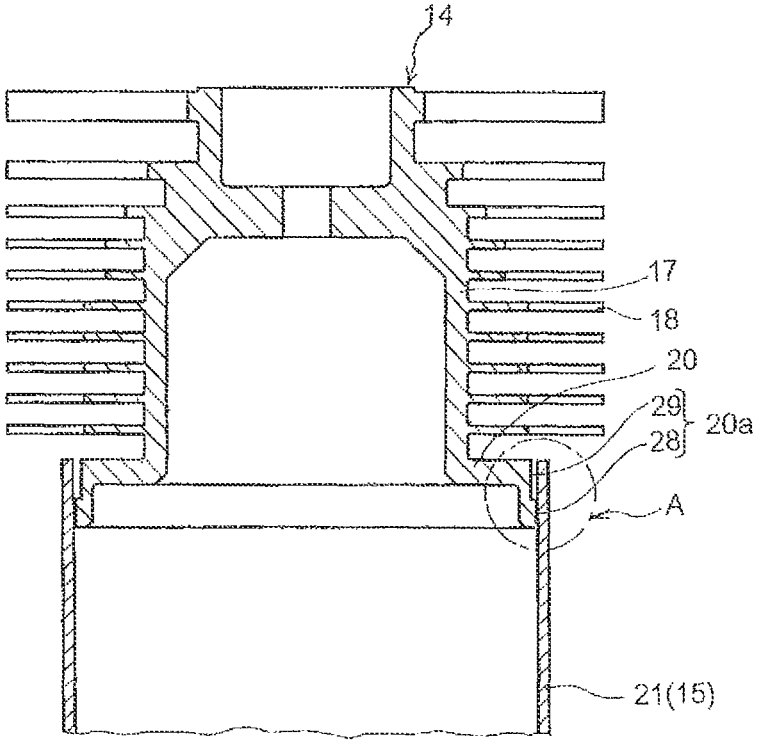
FIG. 2 is a vertical cross-sectional diagram illustrating a joining structure of a rotor of a turbo-molecular pump section and a cylindrical rotor of a thread groove pump section in the vacuum pump.
Figure 3:
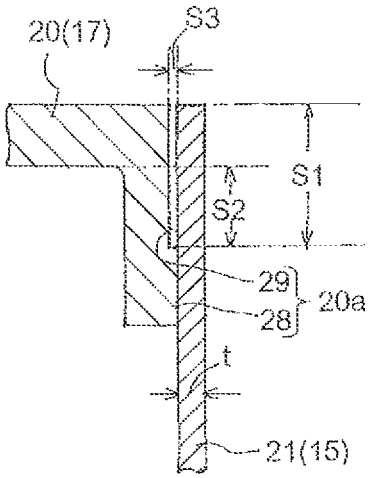
FIG. 3 is an enlarged diagram of portion A in FIG. 2.
Figure 4:
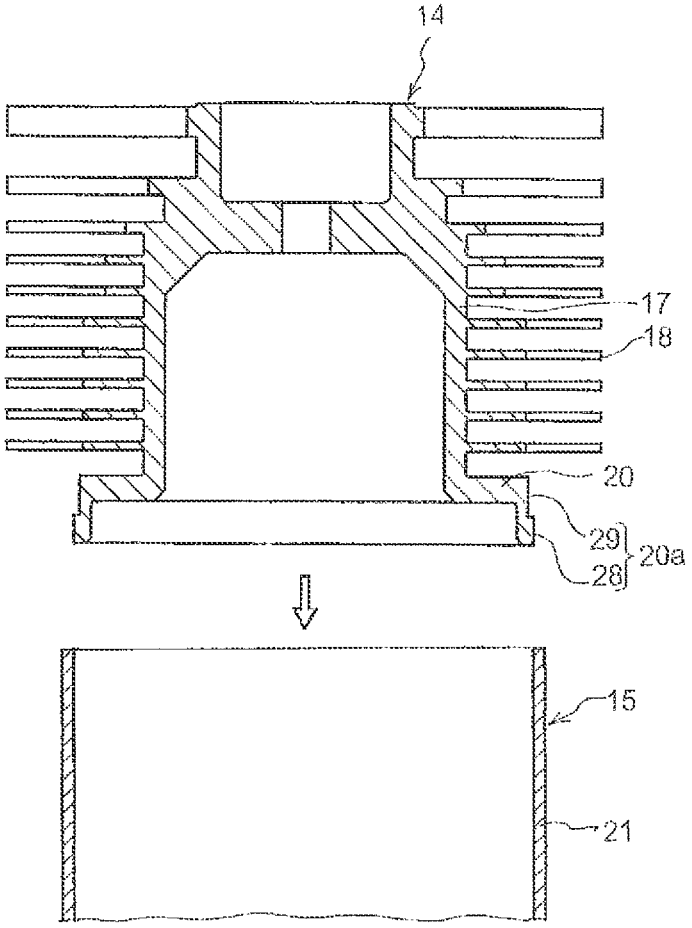
FIG. 4 is a diagram for explaining a joining method of the rotor of the turbo-molecular pump section and the cylindrical rotor of the thread groove pump section in the vacuum pump.

Preferred embodiments of the composite-type vacuum pump of the present invention are explained below with reference to accompanying drawings. FIG. 1 and FIG. 2 illustrate a composite-type vacuum pump according to the present invention. FIG. 1 is a vertical cross-sectional diagram of the composite-type vacuum pump. FIG. 2 is a vertical cross-sectional diagram illustrating a joining structure of a rotor of a turbo-molecular pump section of the pump and a cylindrical rotor of a thread groove pump section. FIG. 3 is an enlarged cross-sectional diagram of portion A of FIG. 2. FIG. 4 is a vertical cross-sectional diagram illustrating, in an exploded manner, a joining portion between the rotor of the turbo-molecular pump section and the cylindrical rotor of the thread groove pump section that are illustrated in FIG. 2.

In the figure, the composite-type vacuum pump 10 comprises a chassis 13 having an intake port 11 and a discharge port 12. Inside the chassis 13 there is provided a turbo-molecular pump section 14 at the top, and a cylindrical thread groove pump section 15 below the turbo-molecular pump section 14, and there is formed a discharge passage 24 that passes through the interior of the turbo-molecular pump section 14 and the thread groove pump section 15 and that communicates the intake port 11 with the discharge port 12.

More specifically, the discharge passage 24 elicits mutual communication between a gap formed between the inner peripheral face of the chassis 13 and the outer peripheral face of a below-described opposing rotor 17 of the turbo-molecular pump section 14, and a gap between the inner peripheral face of a stator 23 and the outer peripheral face of a below-described cylindrical rotor 21 of the thread groove pump section 15. Also, the discharge passage 24 is formed so as to communicate the upper end side of the gap on the turbo-molecular pump section 14 side with the intake port 11, and to communicate the lower end side of the gap on the thread groove pump section 15 side with the discharge port 12.

The turbo-molecular pump section 14 results from combining multiple rotor blades 18, 18 . . . projecting from the outer peripheral face of the rotor 17, made of an aluminum alloy and fixed to a rotating shaft 16, with multiple stator blades 19, 19 . . . that project from the inner peripheral face of the chassis 13.

The thread groove pump section 15 comprises: the cylindrical rotor 21 that is mounted, through press-fit fixing, to a joint portion 20*a*, i.e. to the outer periphery of an annular-brim portion 20, having an L-shaped cross section, that is protrudingly provided at the outer peripheral face of the lower end section of the rotor 17 in the turbo-molecular pump section 14; and the stator 23, which opposes the cylindrical rotor 21, with a small gap between the outer periphery of the cylindrical rotor 21 and the stator 23, and in which there is disposed a thread groove 22 that is formed by the abovementioned small gap and part of the discharge passage 24.

The thread groove 22 of the stator 23 is formed in such a manner that the depth of the thread groove 22 grows shallower in the downward direction. The stator 23 is fixed to an inner face of the chassis 13. The lower end of the thread groove 22 communicates with the discharge port 12 at the furthest downstream side of the discharge passage 24. The joining portion of the rotor 17 of the turbo-molecular pump section 14 and the cylindrical rotor 21 of the thread groove pump section 15 is disposed upstream of the discharge passage 24.

A rotor 26*a* of a high-frequency motor 26, such as an induction motor or the like that is provided in a motor chassis 25, is fixed to an intermediate section of the rotating shaft 16. The rotating shaft 16 is supported on a magnetic bearing, and is provided with upper and lower protective bearings 27, 27.

The cylindrical rotor 21 is formed, to a cylindrical shape, in the form of a composite layer that is obtained by aligning fibers in such a way so as to share forces in both the circumferential direction and the axial direction.

The joint portion 20*a* is provided with a contact portion 28 having an outer diameter that is slightly larger than the inner diameter of the cylindrical rotor 21 and that enables press-fitting into the cylindrical rotor 21, and with a small-diameter section 29 that is positioned above the contact portion 28 and that has an outer diameter smaller than the inner diameter of the cylindrical rotor 21.

As illustrated in FIG. 4, the joint portion 20*a* is matched to the upper end side of the cylindrical rotor 21, is then inserted into the cylindrical rotor 21, as illustrated in FIG. 1 and FIG. 2, and the contact portion 28 of the joint portion 20*a* is pressure-welded to the inner face of the cylindrical rotor 21, to mount as a result the rotor 17 onto the cylindrical rotor 21. The contact portion 28 and the cylindrical rotor 21 can be fixed to each other, as the case may require, by way of an adhesive or the like.

In the structure of the present embodiment, the joint portion 20*a* is inserted up to a position at which the top face of the joint portion 20*a* and the upper end face of the cylindrical rotor 21 match substantially each other; thereupon, the outer peripheral face of the contact portion 28 is pressure-welded to the inner peripheral face of the cylindrical rotor 21, so that a gap S3 is provided between the inner peripheral face of the cylindrical rotor 21 and the outer peripheral face of the small-diameter section 29, as illustrated in detail in FIG. 3. In the structure of the present embodiment, members are formed in such a manner that the distance from the upper end face of the cylindrical rotor 21 up to the contact portion 28, i.e. a distance S1 of the small-diameter section 29, is twice or more a thickness t of the cylindrical rotor 21, and in such a manner that there is obtained a sufficient distance S2 from the bottom face of the rotor 17 of the turbo-molecular pump section 14 up to the contact portion 28.

The operation of the composite-type vacuum pump of the above embodiment is explained next. Gas that flows in through the intake port 11, as a result of driving by the high-frequency motor 26, is in a molecular flow state or in an intermediate flow state close to a molecular flow state. The rotating rotor blades 18, 18 . . . in the turbo-molecular pump section 14 and the stator blades 19, 19 . . . that project from the chassis 13 impart downward momentum to the gas molecules, and the gas is compressed and caused to move downward by the rotor blades 18, 18 . . . that rotate at high speed.

The compressed and moving gas is guided, in the thread groove pump section 15, by the rotating cylindrical rotor 21, and by the thread groove 22 that becomes shallower along the stator 23 that is formed having a small gap with respect to the cylindrical rotor 21. The gas flows through the interior of the discharge passage 24 while being compressed up to a viscous flow state, and is discharged out of the discharge port 12.

The cylindrical rotor 21 and the rotor 17 come into contact with each other at a position removed by a sufficient distance S1 from the end face of the cylindrical rotor 21. Therefore, when a high load acts between the contact portion 28 and the cylindrical rotor 21, the contact portion 28 deflects with respect to the small-diameter section 29 and absorbs the load. The cylindrical rotor 21 can be protected thereby. Though simple, the above structure imparts as a result such strength as allows withstanding high loads, and makes higher rotation speed possible. The contact portion 28 and the cylindrical rotor 21 come into contact with each other below the bottom face of the rotor 17 of the turbo-molecular pump section 14. Therefore, yet greater deflection of the contact portion 28 is achieved when a high load acts between the contact portion 28 and the cylindrical rotor 21.

Figure 5:
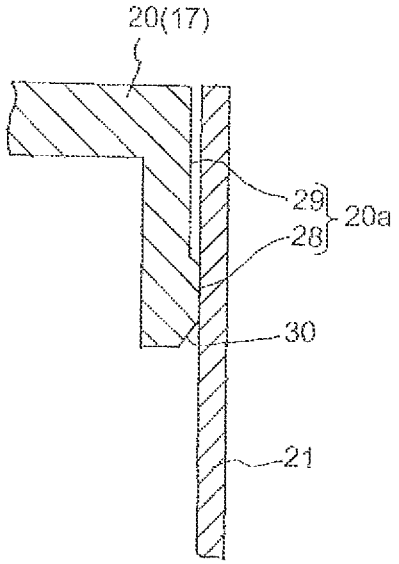
FIG. 5 is a diagram illustrating a variation of the joining structure illustrated in FIG. 3.

In the structure of the composite-type vacuum pump 10, an oblique guiding inclined surface 30, the outer diameter whereof is smaller than the inner diameter of the cylindrical rotor 21, may be provided at the lower end section of the contact portion 28, for instance as illustrated in FIG. 5. By virtue of this configuration, the joint portion 20*a* of the rotor 17 can be inserted smoothly, using the guiding inclined surface 30 as a guide, into the upper end section of the cylindrical rotor 21, and the assembly operation can be made easier, which allows reducing costs. The assembly operation can be made yet easier by cooling fitting, i.e. by cooling the joint portion 20*a*, so that the outer diameter dimension contracts beforehand, and by inserting then the joint portion 20*a* in that state.

Figure 6:
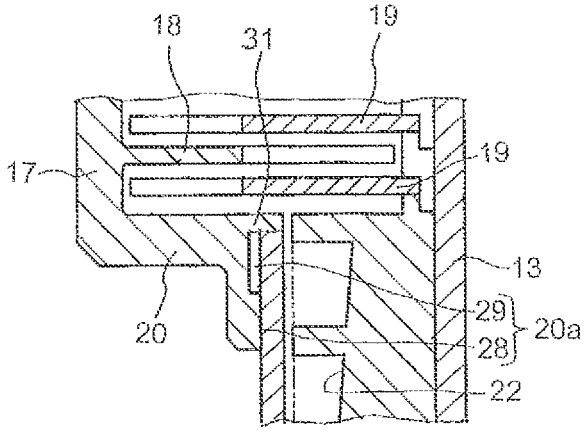
FIG. 6 is a vertical cross-sectional diagram illustrating another joining structure of the rotor of the turbo-molecular pump section and the cylindrical rotor of the thread groove pump section in the vacuum pump.

In the structure of the composite-type vacuum pump 10, there may be provided a stopper 31, which restricts the extent of insertion in the cylindrical rotor 21, on the rotor 17 side of the turbo-molecular pump section 14, namely at the upper end section of the small-diameter section 29, for instance as illustrated in FIG. 6. In this configuration, the rotor 17 and the cylindrical rotor 21 can be mounted in a simple manner, at a predetermined position, and assembly precision can be stabilized, by, upon insertion of the joint portion 20*a* of the rotor 17 into the upper end section of the cylindrical rotor 21, causing the joint portion 20*a* to be inserted thus until the top end face of the cylindrical rotor 21 abuts the stopper 31.

Figure 7:
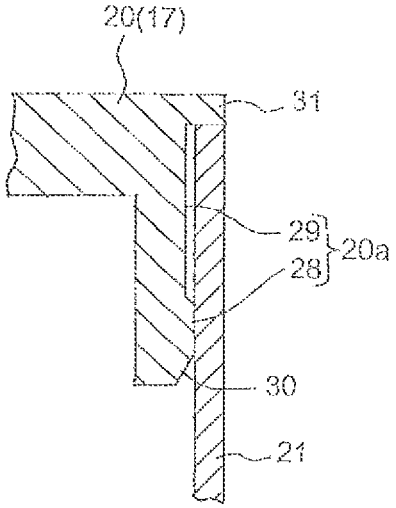
FIG. 7 is a diagram illustrating a variation of the joining structure illustrated in FIG. 6.

In the variation illustrated in FIG. 6, the oblique guiding inclined surface 30, the outer diameter whereof is smaller than the inner diameter of the cylindrical rotor 21, may be provided at the lower end section of the contact portion 28, for instance as illustrated in FIG. 7, in the same way as in the structure illustrated in FIG. 5. By virtue of this configuration, the joint portion 20*a* of the rotor 17 can be inserted smoothly, using the guiding inclined surface 30 as a guide, into the upper end section of the cylindrical rotor 21, and the assembly operation can be made easier, which allows reducing costs.

Figure 8:
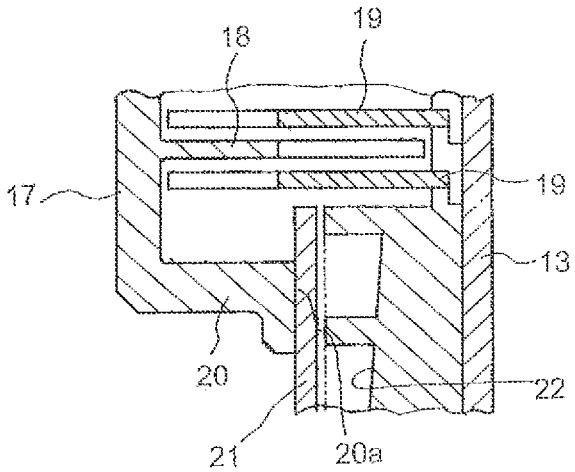
FIG. 8 is a vertical cross-sectional diagram illustrating yet another joining structure of the rotor of the turbo-molecular pump section and the cylindrical rotor of the thread groove pump section in the vacuum pump.
Figure 9:
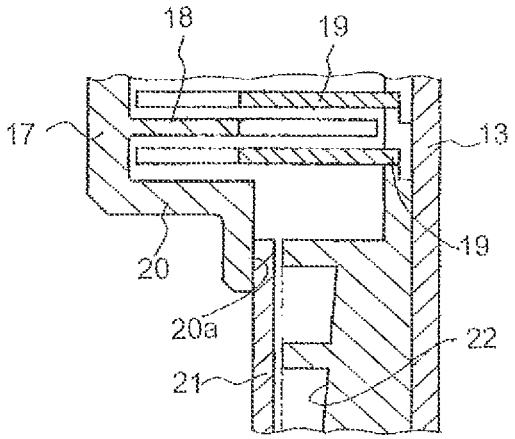
FIG. 9 is a vertical cross-sectional diagram illustrating yet another joining structure of the rotor of the turbo-molecular pump section and the cylindrical rotor of the thread groove pump section in the vacuum pump.

The structure of the composite-type vacuum pump 10 may be a structure such that the upper end section of the cylindrical rotor 21 protrudes significantly above the upper end face of the joint portion 20*a*, for instance as illustrated in FIG. 8, or a structure such that the upper end of the cylindrical rotor 21 is significantly escaped below the lower face of the joint portion 20*a*, as illustrated in FIG. 9. In the structures of FIG. 8 and FIG. 9, a guiding inclined surface 30 may be provided, as in the structure of joint portion 20*a* illustrated in FIG. 5 and FIG. 7, such that the joint portion 20*a* of the rotor 17 can be inserted smoothly, using the guiding inclined surface 30 as a guide, into the upper end section of the cylindrical rotor 21. In the structure of FIG. 9, stress acting on the upper end of the cylindrical rotor can be reduced through drawing of the upper end of the cylindrical rotor below the annular-brim portion. Herein, stress acting on the upper end of the cylindrical rotor can be reduced through deflection of the L-shaped portion, even if the upper end of the cylindrical rotor does not stand above the annular-brim portion. Unity of invention is afforded thus in a method for reducing stress that acts on the cylindrical rotor upper end.

Figure 10:
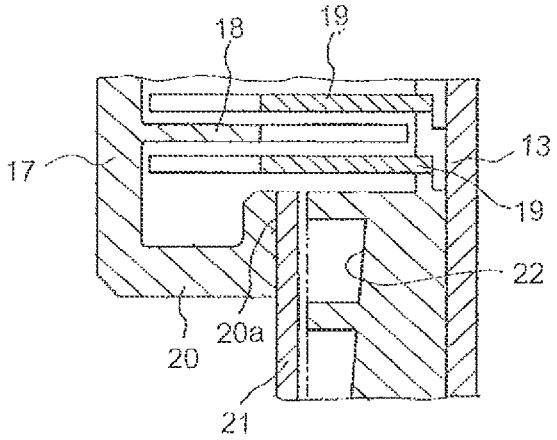
FIG. 10 is a vertical cross-sectional diagram illustrating yet another joining structure of the rotor of the turbo-molecular pump section and the cylindrical rotor of the thread groove pump section in the vacuum pump.

In the structure where the upper end section of the cylindrical rotor 21 protrudes significantly above the upper end face of the joint portion 20*a*, as illustrated in FIG. 8, or the structure where the upper end section of the cylindrical rotor 21 is significantly escaped below the lower face of the joint portion 20*a*, as illustrated in FIG. 9, the stress acting on the upper end section of the cylindrical rotor 21 can be reduced even if the small-diameter section 29 is omitted. Alternatively, the joint portion may be formed to an L-shape that protrudes upward from the annular-brim portion, such that the upper end face of the cylindrical rotor is escaped above the annular-brim portion, as illustrated in FIG. 10.

Specific embodiments of the present invention have been explained above, but the vacuum pump of the present invention is not limited to those embodiments, and may accommodate various modifications without departing from the spirit and scope of the invention. Modifications other than the above-described variations are likewise encompassed, as a matter of course, by the present invention.

Figure 11:
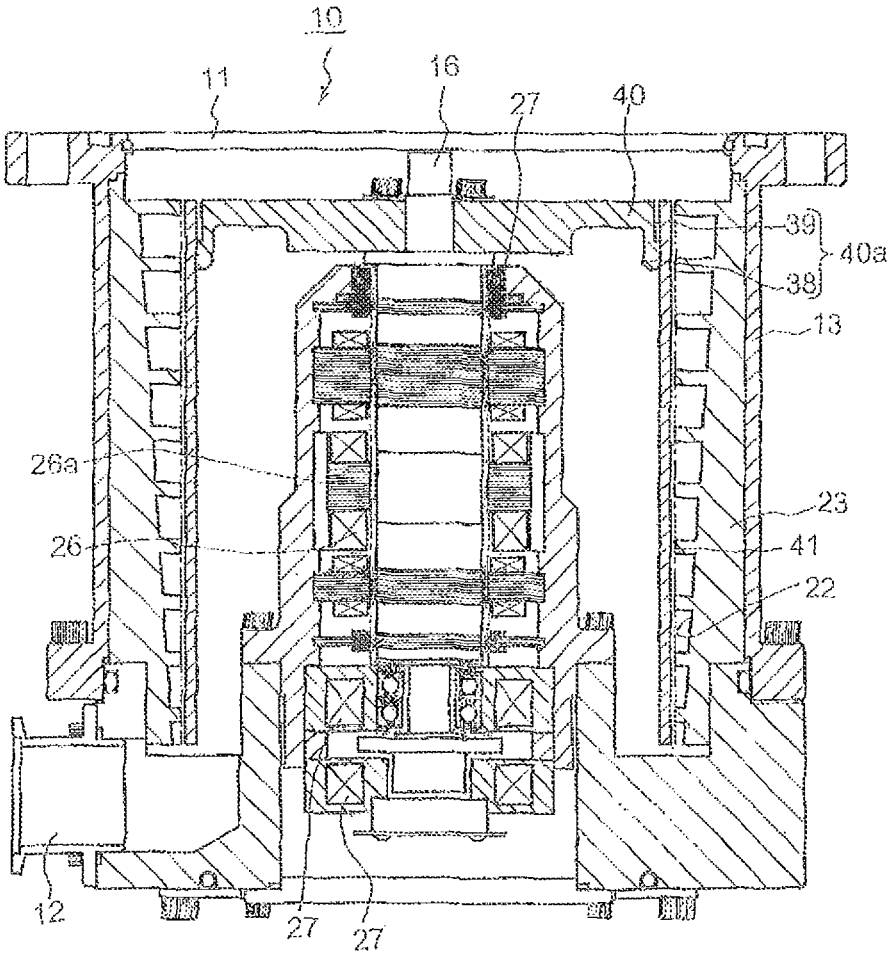
FIG. 11 is a vertical cross-sectional diagram of vacuum pump illustrated as another embodiment of the present invention.
Figure 12:
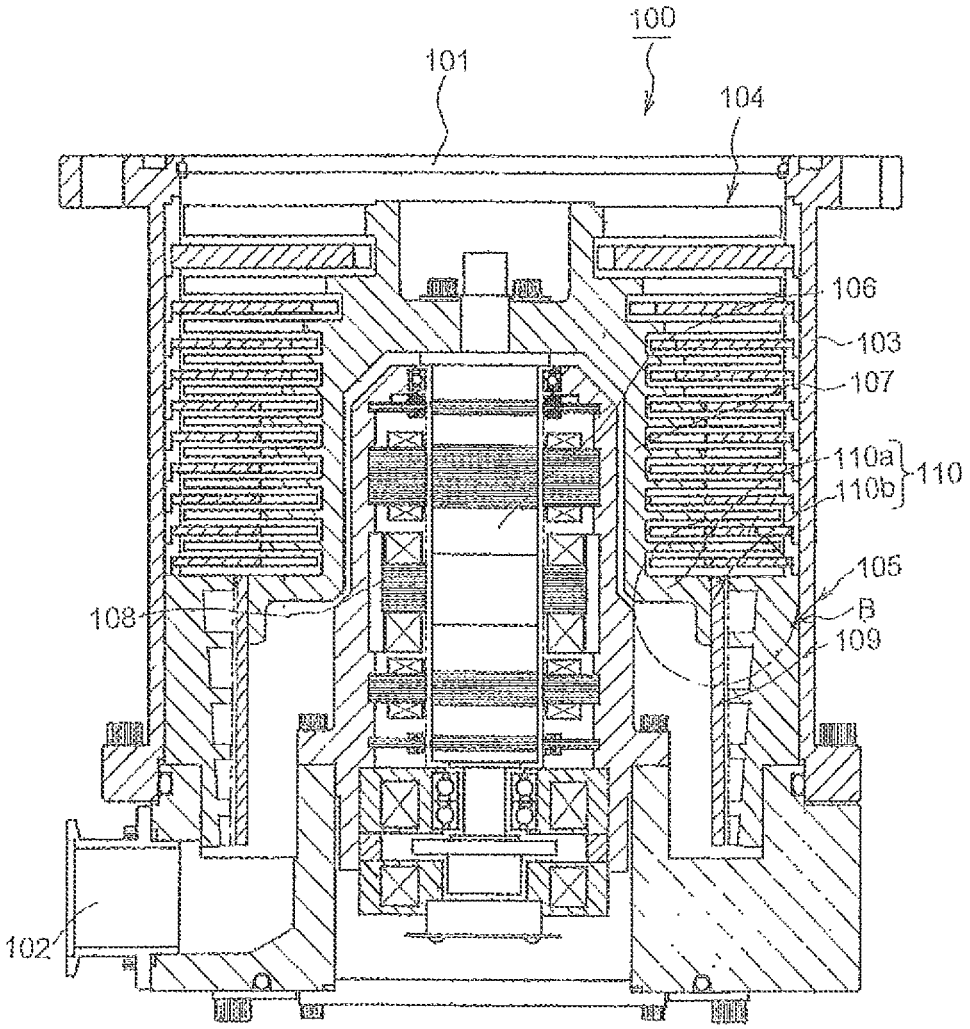
FIG. 12 is a vertical cross-sectional diagram of a composite-type vacuum pump illustrated as a conventional embodiment.
Figure 13:
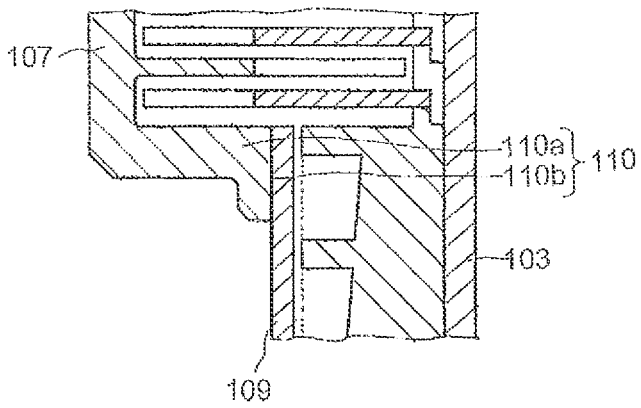
FIG. 13 is an enlarged diagram of portion B in FIG. 12.

Other than in composite-type vacuum pumps, as described above, the present invention can also be used in various devices that utilize a cylindrical rotor that is obtained by shaping an FRP material to a cylindrical shape. For instance, the present invention may be used in a vacuum pump provided with only a thread groove pump section, as in the vertical cross-sectional diagram of a vacuum pump in another embodiment of the present invention illustrated in FIG. 11. In this case, a cylindrical rotor 41 is mounted, through press-fit fixing, to a joint portion 40*a*, i.e. to the outer periphery of an annular-brim portion 40 that is fixed to the rotating shaft 16. The operation of the pump is identical to the operation of the thread groove pump section 15 of FIG. 1.

In the present invention, examples have been explained wherein the cylindrical rotor uses an FRP material, but identical effects are expected to be elicited in the case of a metallic cylindrical rotor. That is, stress acting on the top end face of the cylindrical rotor can be reduced, and propagation of cracks from scratches or the like in the vicinity of the end face can be prevented, so that the strength of the rotor can be increased as a result, even in the case of a metallic cylindrical rotor.

EXPLANATION OF REFERENCE NUMERALS

10 composite-type vacuum pump
11 intake port
12 discharge port
13 chassis
14 turbo-molecular pump section
15 thread groove pump section
16 rotating shaft
17 rotor
18 rotor blade
19 stator blade
20, 40 annular-brim portion
20*a* joint portion
21, 41 cylindrical rotor
22 thread groove
23 stator
24 discharge passage
25 motor chassis
26 high-frequency motor
26*a* rotor
27 protective bearing

28 contact portion
29 small-diameter section
30 guiding inclined surface
31 stopper
38 contact portion
39 small-diameter section
40*a* joint portion

What is claimed is:

1. A vacuum pump comprising:

a cylindrical rotor that constitutes at least a thread groove pump section or a Goethe pump section, etc.; and a second rotor that connects said cylindrical rotor and a rotating shaft to each other, the vacuum pump being configured by joining a part of a side surface of said cylindrical rotor to a joint portion that is provided at a flange-like annular portion formed in said second rotor, wherein an upper end surface of said cylindrical rotor protrudes above a contact portion between said cylindrical rotor and said second rotor and is apart from said flange-like annular portion to a diameter direction.

2. A vacuum pump comprising:

a cylindrical rotor that constitutes at least a thread groove pump section or a Goethe pump section, etc.; and a second rotor that connects said cylindrical rotor and a rotating shaft to each other, the vacuum pump being configured by joining a part of a side surface of said cylindrical rotor to a joint portion that is provided at a flange-like annular portion formed in said second rotor, wherein said joint portion is formed in an L-shape that protrudes below said flange-like annular portion, and an upper end surface of said cylindrical rotor is escaped below an undersurface of said flange-like annular portion.

3. A vacuum pump comprising:

a cylindrical rotor that constitutes at least a thread groove pump section or a Goethe pump section, etc.; and a second rotor that connects said cylindrical rotor and a rotating shaft to each other, the vacuum pump being configured by joining a part of a side surface of said cylindrical rotor to a joint portion that is provided at an outermost peripheral part of a flange-like annular portion formed in said second rotor, wherein said joint portion is formed in an L-shape that protrudes above said flange-like annular portion, and an upper end surface of said cylindrical rotor is disposed above said flange-like annular portion.

4. A vacuum pump comprising:

a cylindrical rotor that constitutes at least a thread groove pump section or a Goethe pump section, etc.; and a second rotor that connects said cylindrical rotor and a rotating shaft to each other, the vacuum pump being configured by joining a part of a side surface of said cylindrical rotor to a joint portion that is provided at a flange-like annular portion formed in said second rotor, wherein said joint portion is formed in an L-shape that protrudes below said flange-like annular portion, a small-diameter section is provided at an upper portion of said joint portion, a contact portion between said cylindrical rotor and said second rotor is escaped below said flange-like annular portion, and an upper end surface of said cylindrical rotor protrudes above said contact portion and is apart from said flange-like annular portion to the diameter direction.

5. The vacuum pump according to claim 1 or 4, wherein a length of a protruding portion of said cylindrical rotor is twice or more a thickness of said cylindrical rotor.

6. The vacuum pump according to claim 1, 2, 3, or 4, wherein said second rotor constitutes a pump mechanism represented by at least a turbo-molecular pump section or a vortex pump section.

7. The vacuum pump according to claim 5, wherein said second rotor constitutes a pump mechanism represented by at least a turbo-molecular pump section or a vortex pump section.

* * * * *